US007896407B2

(12) United States Patent
Di Vinadio

(10) Patent No.: US 7,896,407 B2
(45) Date of Patent: Mar. 1, 2011

(54) AUXILIARY SAFETY MODULE FOR DOORS PROVIDED WITH ANTI-PANIC OPENING DEVICE

(75) Inventor: Aimone Balbo Di Vinadio, Chiusa San Michele (IT)

(73) Assignee: Savio S.p.A., Chiusa San Michele (Torino) (IT)

( * ) Notice: Subject to any disclaimer, the term of this patent is extended or adjusted under 35 U.S.C. 154(b) by 656 days.

(21) Appl. No.: 11/833,843

(22) Filed: Aug. 3, 2007

(65) Prior Publication Data

US 2008/0034818 A1 Feb. 14, 2008

(30) Foreign Application Priority Data

Aug. 9, 2006 (EP) ..... 06425585

(51) Int. Cl.
*E05B 65/10* (2006.01)
*E05C 5/00* (2006.01)

(52) U.S. Cl. ..... 292/92; 292/21; 292/93; 292/DIG. 65

(58) Field of Classification Search ..... 292/3, 8, 292/21, 24, 26, 30, 35, 39, 51, 53, 92–95, 292/112, 119, 160, 169.13, DIG. 65, DIG. 21; 70/92; 49/141, 394, 395
See application file for complete search history.

(56) References Cited

U.S. PATENT DOCUMENTS 1,504,176 A * 8/1924 James ..... 70/116
2,887,336 A 5/1959 Meyer
2,911,249 A * 11/1959 Gesing et al. ..... 292/336

(Continued)

FOREIGN PATENT DOCUMENTS

EP 0787883 A1 8/1997

(Continued)

OTHER PUBLICATIONS

European Search Report for EP Application No. EP06425585 dated Jan. 17, 2007.

*Primary Examiner* — Carlos Lugo
*Assistant Examiner* — Alyson M Merlino
(74) *Attorney, Agent, or Firm* — Heslin Rothenberg Farley & Mesiti P.C.; Victor A. Cardona

(57) ABSTRACT

Auxiliary safety module for doors provided with an anti-panic opening device, comprising, a rotating locking member movable between an extracted position and a recessed position, a first elastic element tending to maintain the locking member in its extracted position, a cursor movable between a first position and a second position, a transmission mechanism operatively associated to the cursor and to the locking member and arranged to establish a univocal correlation between the positions of the cursor and of the locking member, so that when the cursor is in its first position, the locking member is in the extracted position and when the cursor is in the second position, the locking member is in the recessed position, a movable feeler having a projecting portion and a retaining portion which co-operates with the cursor, the feeler being movable between an engaged position and a disengaged position, a second elastic element associated to the feeler and tending to maintain the feeler in said engaged position, wherein, when the feeler is in its disengaged position, the cursor is free to move between the first and the second position and vice versa and wherein when the feeler is in the engaged position, the cursor is locked in its second position.

2 Claims, 16 Drawing Sheets

U.S. PATENT DOCUMENTS

| | | | | | |
|---|---|---|---|---|---|
| 3,029,096 | A | * | 4/1962 | Welch | 292/336 |
| 3,345,099 | A | * | 10/1967 | Paul et al. | 292/21 |
| 3,582,122 | A | * | 6/1971 | Foster et al. | 292/335 |
| 3,583,740 | A | * | 6/1971 | Armstrong | 292/198 |
| 3,767,239 | A | | 10/1973 | Horgan, Jr. | |
| 3,788,687 | A | * | 1/1974 | Zawadzki | 292/92 |
| 4,050,272 | A | * | 9/1977 | Tanaka | 70/100 |
| 4,796,931 | A | * | 1/1989 | Heid | 292/92 |
| 4,819,976 | A | * | 4/1989 | Bert | 292/48 |
| 5,042,851 | A | * | 8/1991 | Hunt | 292/21 |
| 5,172,944 | A | * | 12/1992 | Munich et al. | 292/39 |
| 5,464,259 | A | * | 11/1995 | Cohrs et al. | 292/92 |
| 5,595,409 | A | * | 1/1997 | Fier et al. | 292/112 |
| 5,816,017 | A | * | 10/1998 | Hunt et al. | 52/784.11 |
| 6,641,183 | B2 | * | 11/2003 | Brown | 292/92 |
| 6,820,905 | B1 | * | 11/2004 | Haeck et al. | 292/93 |
| 6,945,571 | B2 | * | 9/2005 | Lin | 292/92 |
| 7,144,050 | B2 | * | 12/2006 | Lin | 292/93 |
| 7,287,784 | B2 | * | 10/2007 | Lin | 292/92 |

FOREIGN PATENT DOCUMENTS

| | | | |
|---|---|---|---|
| EP | 0945572 | A2 | 9/1999 |
| FR | 2601062 | A1 | 1/1988 |
| FR | 2732062 | A1 | 9/1996 |
| FR | 2781003 | A1 | 1/2000 |
| GB | 383359 | | 11/1932 |

* cited by examiner

AUXILIARY SAFETY MODULE FOR DOORS PROVIDED WITH ANTI-PANIC OPENING DEVICE

CROSS-REFERENCE TO RELATED APPLICATIONS

This application claims benefit of European patent application number 06425585.4, filed Aug. 9, 2006, which is herein incorporated by reference.

BACKGROUND OF THE INVENTION

1. Field of the Invention

The present invention relates in general to doors provided with anti-panic opening devices.

2. Description of the Related Art

A typical anti-panic opening device for doors comprises an actuating bar that commands the disengagement of a main spring latch. In addition to the main spring latch, doors provided with anti-panic opening devices can be provided with an auxiliary closing mechanism with upper and lower spring latch, connected to the actuation device by means of vertical rods.

Doors fitted with anti-panic opening devices generally have the drawback of providing little protection against burglary attempts.

There is considerable difficulty in enhancing the degree of security against burglary of doors fitted with anti-panic opening devices. Reference standards for anti-panic opening devices prescribe that the door must be opened with the application of a very small force on the actuating bar, even if a sizeable load stressing the spring latches is applied to the door. An additional security closing mechanism must not compromise the ability of the anti-panic device to open in the conditions prescribed by the standards and it must also re-establish the condition of security closure after each opening and closing of the door.

SUMMARY OF THE INVENTION

The object of the present invention is to provide an auxiliary security module for doors provided with an anti-panic opening device that enables to meet the aforesaid needs.

According to the present invention, said object is achieved by an auxiliary security module having the characteristics set out in claim 1.

BRIEF DESCRIPTION OF THE DRAWINGS

The present invention shall now be described in detail with reference to the accompanying drawings, provided purely by way of non limiting example, in which.

DETAILED DESCRIPTION

Figure 1:
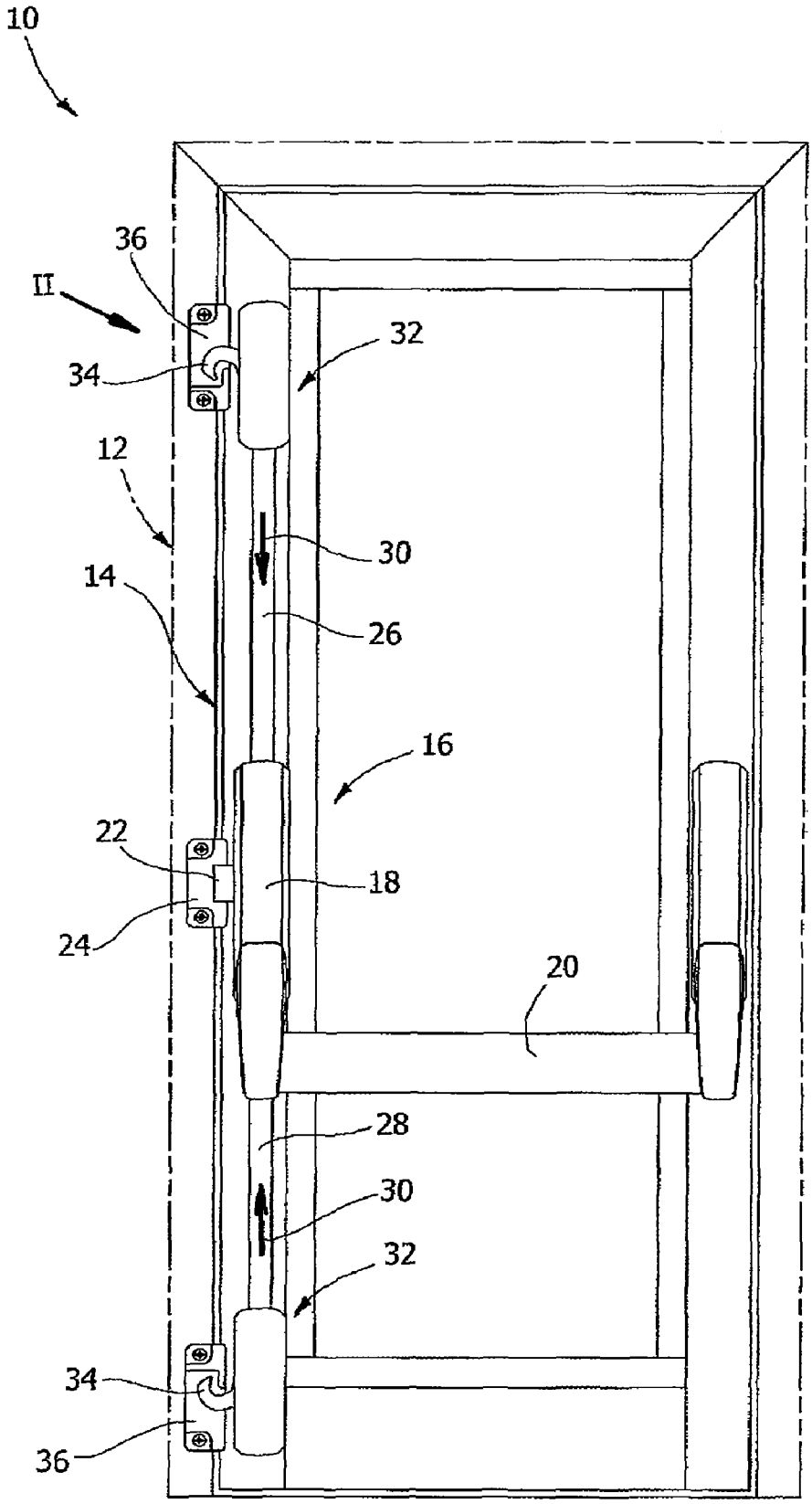
FIG. 1 is a front view of a door provided with two auxiliary security modules according to a first embodiment of the present invention.

With reference to FIG. 1, the number 10 designates a single-wing door, comprising a fixed frame 12 and an openable wing 14. The wing 14 is provided with an anti-panic opening device 16 of a known type. The device 16 comprises an actuation assembly 18 actuated by a bar 20. The actuation assembly 18 comprises a spring latch 22 that co-operates with an abutment 24 fastened to a vertical upright of the fixed frame 12. The actuation assembly 18 further comprises two vertical rods 26, 28 which, as a result of the actuation of the bar 20, move in the direction indicated by the arrows 30. The structure and the operation of the anti-panic device 16 are not described in detail because they are outside the scope of the present invention.

The wing 14 is provided with two auxiliary security modules 32 according to the present invention fastened to the openable wing 14 at the upper edge and at the lower edge of the openable wing 14. The security modules 32 are connected to the rods 26, 28 of the anti-panic opening device 16 and they are provided with respective arresting members 34, each of which co-operates with an engagement seat 36 fastened to the fixed frame 12.

Figure 2:
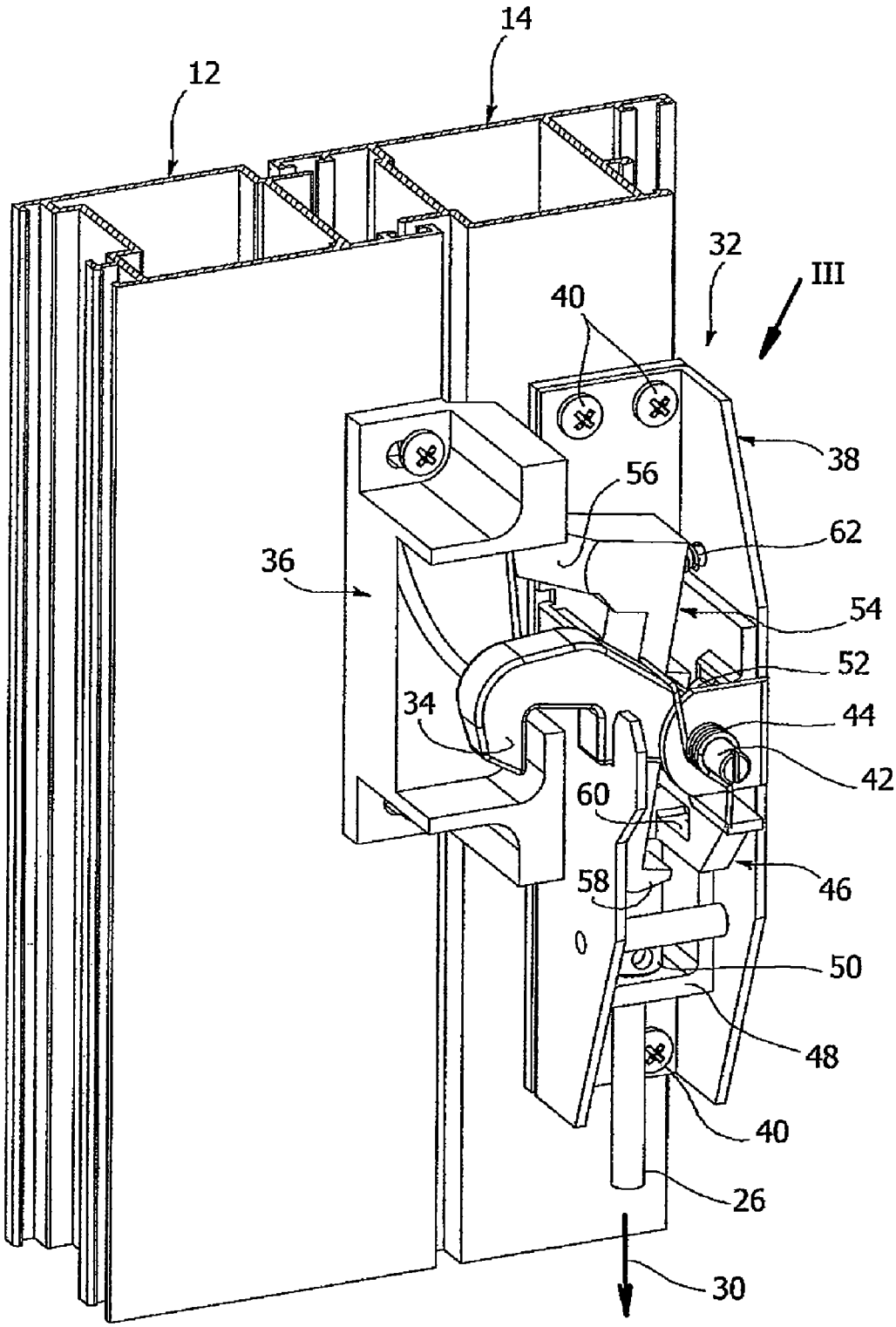
FIG. 2 is a perspective view of the part indicated by the arrow II in FIG. 1, FIGS. 3 and 4 are perspective views of the part indicated by the arrow III in FIG. 2 in two operative positions.
Figure 3:
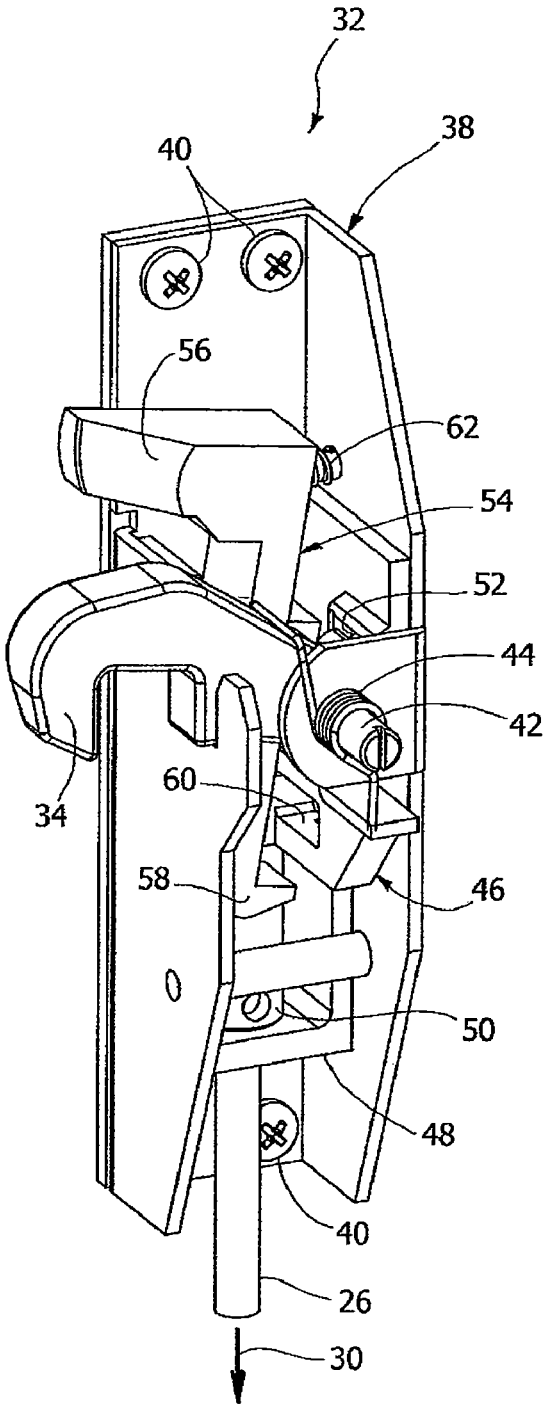
Figure 4:
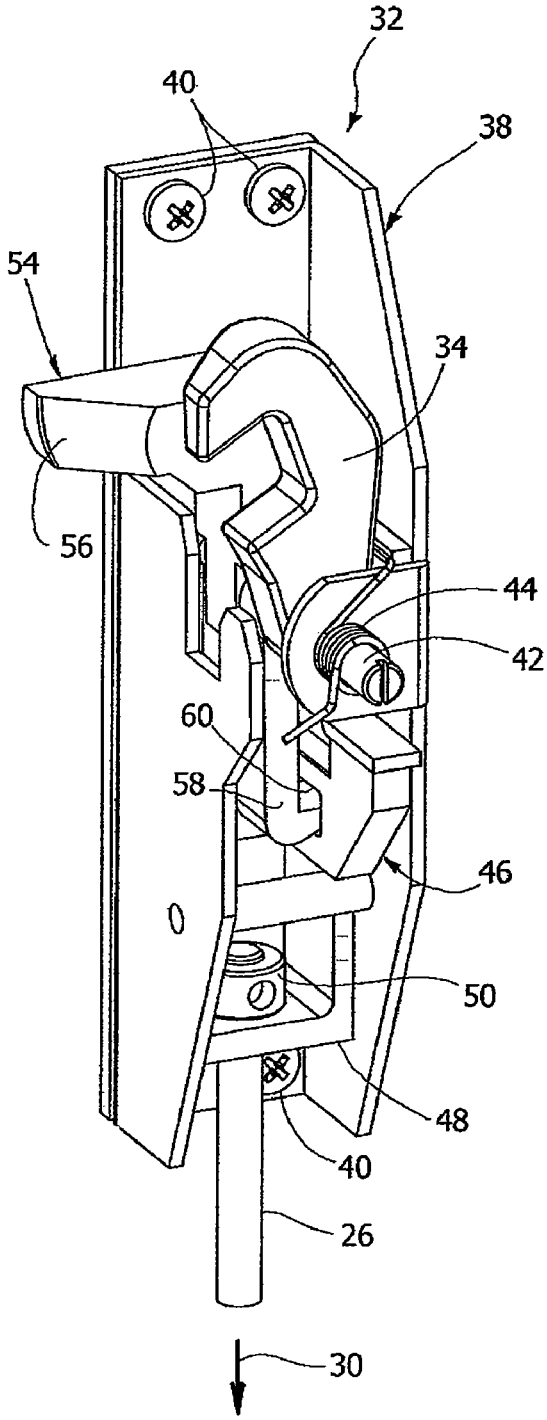

With reference to FIGS. 2 through 4, each auxiliary security module 32 comprises a support case 38 able to be fastened to the openable wing 14, e.g. by means of screws 40. The locking member 34 is articulated to the case 38 around a pivot pin 42 and it has an engagement end that is preferably shaped as a hook. The locking member 34 is movable between an extracted position shown in FIGS. 2 and 3 and a recessed position shown in FIG. 4. A first elastic element 44 tends to maintain the locking member 34 in its extracted position. In the example shown in FIGS. 2 through 5, the first elastic element 44 is constituted by a pin spring positioned axially to the trunnion 42.

Figure 5:
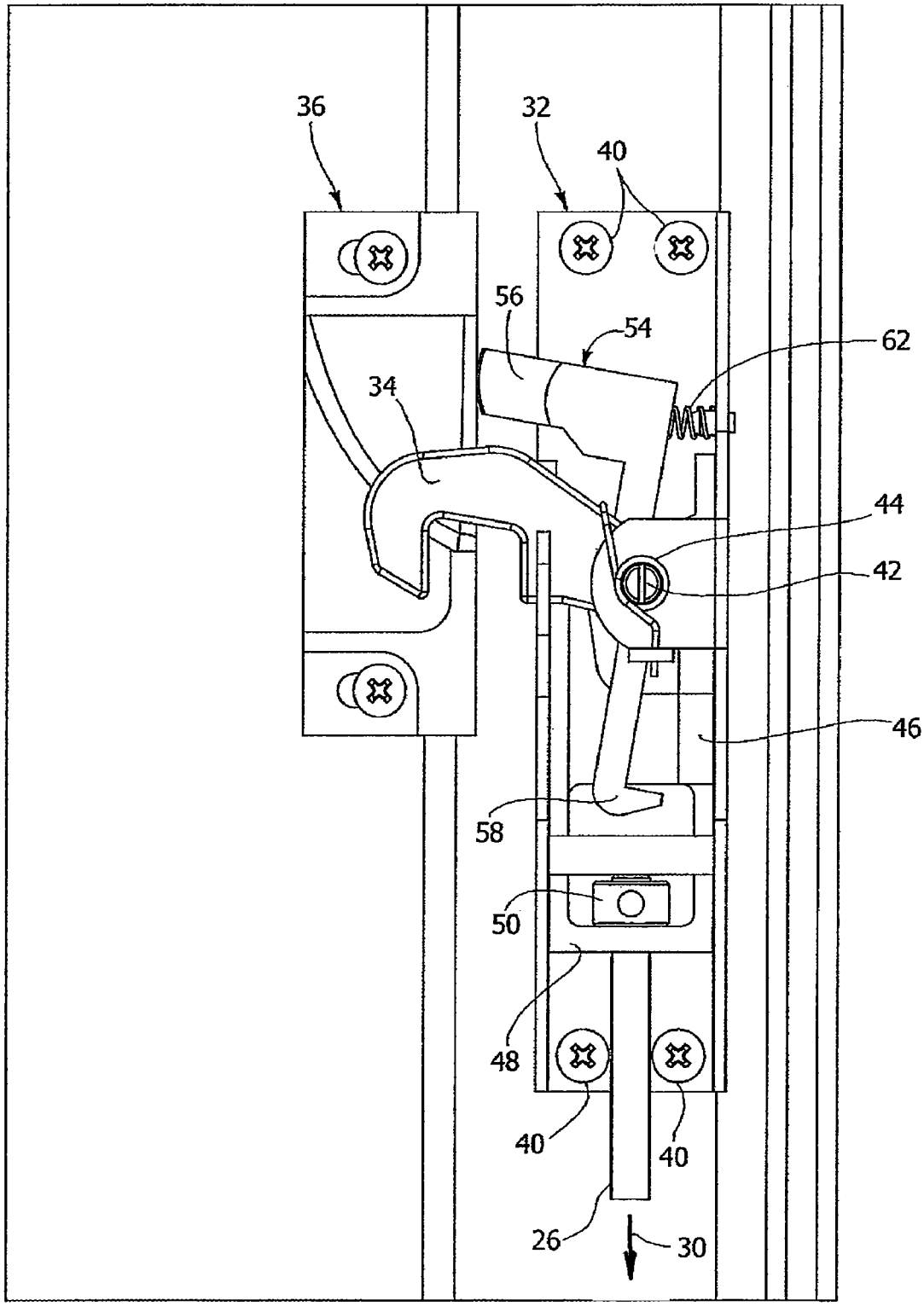
FIG. 5 is a front view of the module shown in FIGS. 2, 3 and 4.

With reference to FIGS. 2 through 5, the auxiliary security module 32 comprises a cursor 46 movable in the case 38 between a first position shown in FIGS. 2, 3 and 5 and a second position shown in FIG. 4. The cursor 46 has a base 48 provided with a hole through which an end of the rod 26 extends with play. On the end of the rod 26 projecting beyond the base 48 is fastened a widened head 50.

The cursor 46 is connected to the locking member 34 by means of a transmission mechanism that establishes a univocal correlation between the positions of the cursor 46 and the positions of the locking member 34. The transmission mechanism can be constituted by a rack and gearwheel mechanism 52 (only partially visible in FIGS. 2 and 3) comprising a toothed sector integral with the locking member 34 and meshing with a rack integral with the cursor 46. When the cursor 46 is in its first position shown in FIGS. 2, 3 and 5, the locking member 34 is in its extracted position. When the cursor 46 is in its second position shown in FIG. 4, the locking member 34 is in its recessed position. The extracted and recessed positions of the locking member correspond respectively to the position of engagement and disengagement with the seat 36 provided on the fixed frame 12. The same elastic element 44 that tends to thrust the locking member 34 towards its extracted position also tends to thrust the cursor 46 towards its first position.

The auxiliary security module 32 comprises a movable feeler 54 having a projecting portion 56 and a retaining portion 58. The retaining portion 58 of the feeler 54 co-operates with an engagement seat 60 of the cursor 46. The feeler 54 is movable between a disengaged position shown in FIGS. 2, 3 and 5 and an engaged position shown in FIG. 4. In the embodiment shown in FIGS. 2 through 5, the feeler 54 is constituted by a rocking lever articulated to the case 38 around the same pivot pin 42 whereon the locking member 34 is articulated. The projecting portion 56 and the engagement portion 58 extend from opposite parts relative to the trunnion 42. The feeler 54 is associated to a second elastic element 62 which tends to thrust the feeler 54 towards its engagement position.

When the wing 14 is closed, the auxiliary security module 32 according to the present invention is in the configuration shown in FIGS. 2, 3 and 5. In this configuration, the locking member 34 is in its extracted position and engages the seat 36 fastened to the fixed frame 12. The cursor 46 is in its first position, in which the engagement seat 60 is offset with respect to the engagement portion 58 of the feeler 54. The projecting portion 56 of the feeler 54 bears against the seat 36 of the fixed frame 12. The feeler 54 is maintained in its disengaged position against the action of the second elastic element 62. The engagement portion 58 of the feeler 54 is disengaged from the seat 60 of the cursor 46. In this configuration, the cursor 46 is free to slide relative to the case 38.

Pressing the actuating lever 20 of the anti-panic device 16, the rod 26 moves in rectilinear direction in the direction indicated by the arrow 30 in FIGS. 2, 3 and 4. This movement of the rod 30 commands the cursor 46 to move from the first towards the second position, which causes the locking member 34 to move from the extracted position towards the recessed position. In the second position, the seat 60 of the cursor 46 is aligned relative to the engagement portion 58 of the feeler 54. When the cursor 46 is in the second position and the locking member 34 is in its recessed position, the wing 14 is unlocked and it can be opened. Opening the wing 14, the feeler 54 is thrust by the second elastic element 62 in its engagement position, in which the engagement portion 58 is inserted into the seat 60 of the cursor 46 (configuration of FIG. 4). In this configuration, the projecting portion 56 extends to a greater extent outside the case 38. The cursor 46 is locked in the second position and, consequently, the locking member 34 is locked in the recessed position, which is a disengaged position relative to the seat 36.

When the door is re-closed the projecting portion 56 of the feeler 54 bears against the fixed seat 36 and the feeler 54 returns to the disengaged position. At this point, the cursor 46 is free to move towards its first position. The first elastic element 44 thrusts the locking member 34 to the extracted position in which it engages the fixed seat 36. Correspondingly, the cursor 46 moves to its first position.

The auxiliary security module 32 according to the present invention represents an additional component with respect to the anti-panic device 16. Maintaining the operating principle unaltered, the module 32 can be specifically designed to operate with the different anti-panic devices available on the market and requires no change to the structure of the anti-panic device.

The safety module 32 constitutes an optional component that can be added to any anti-panic opening device to enhance security against burglary. The security module 32 does not change the operation of the anti-panic device in any way. The disengagement of the locking member 34 from the fixed seat occurs simultaneously with the opening of the spring latch 22 of the anti-panic device 16. The security module 32 is automatically positioned in the locking position when the wing is closed, with no need for manual interventions to reset the device.

In the embodiment shown in FIGS. 2 through 5, the feeler 54 and the locking member 34 are both rotatable around an orthogonal axis relative to the direction of motion of the cursor 46. The feeler pin, however, can be positioned transversely to the cursor 46, provided that it allows to detect the closed door position and to activate a locked condition of the cursor 46 in the open door condition.

FIGS. 6 through 11 show a second embodiment of the auxiliary security module according to the present invention. The details corresponding to the previously described ones are designated by the same numeric references.

Figure 6:
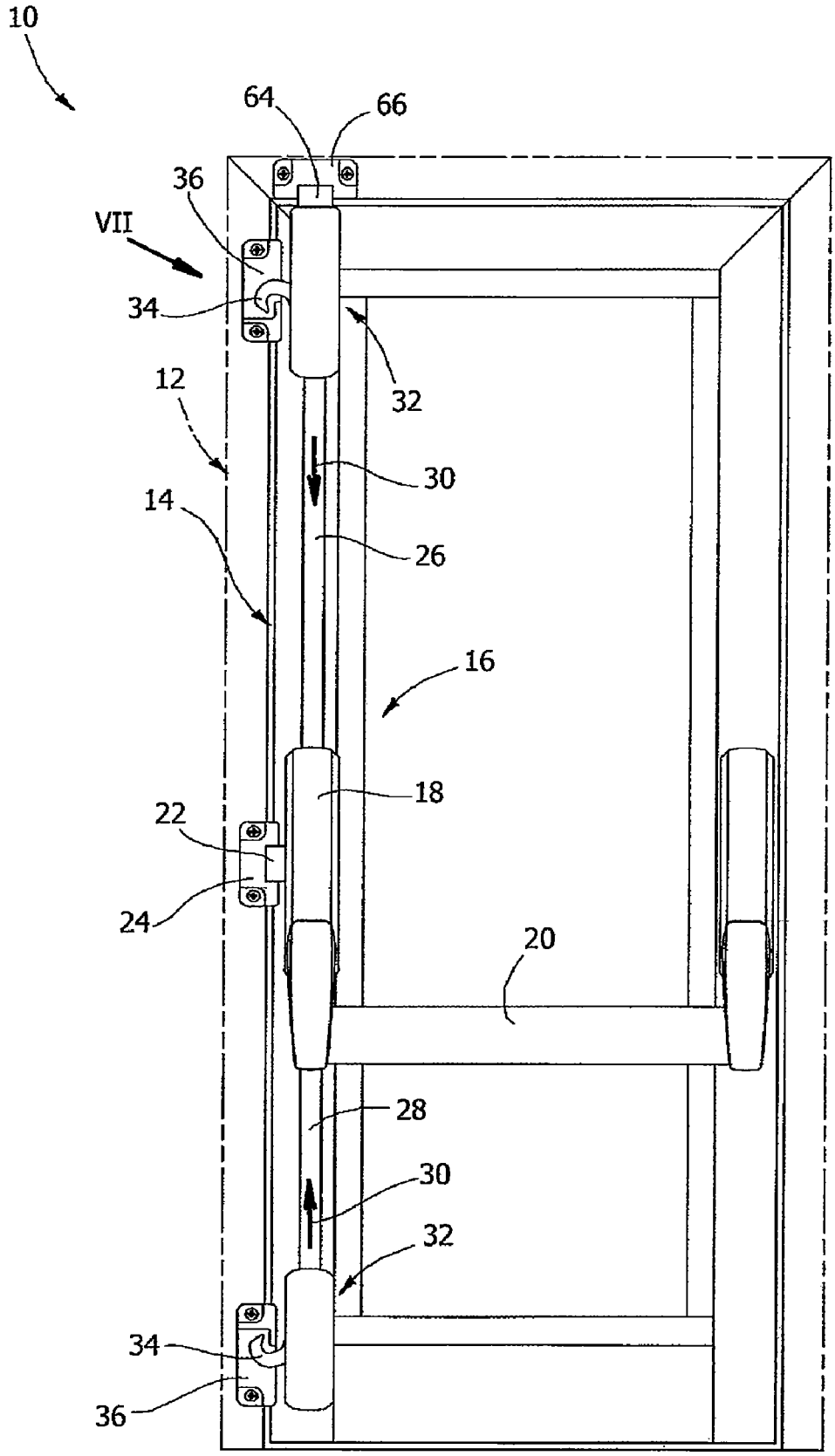
FIG. 6 is a front view of a door provided with a second embodiment of an auxiliary security module according to the invention.

With reference to FIG. 6, the wing 14 is provided with two auxiliary security modules. The differences with respect to the embodiment described above pertain to the upper auxiliary security module. Said module comprises an oscillating spring latch 64 that projects from an upper edge of the openable wing 14 and co-operates with a fixed abutment 66 fastened to an upper cross-member of the fixed frame 12.

Figure 7:
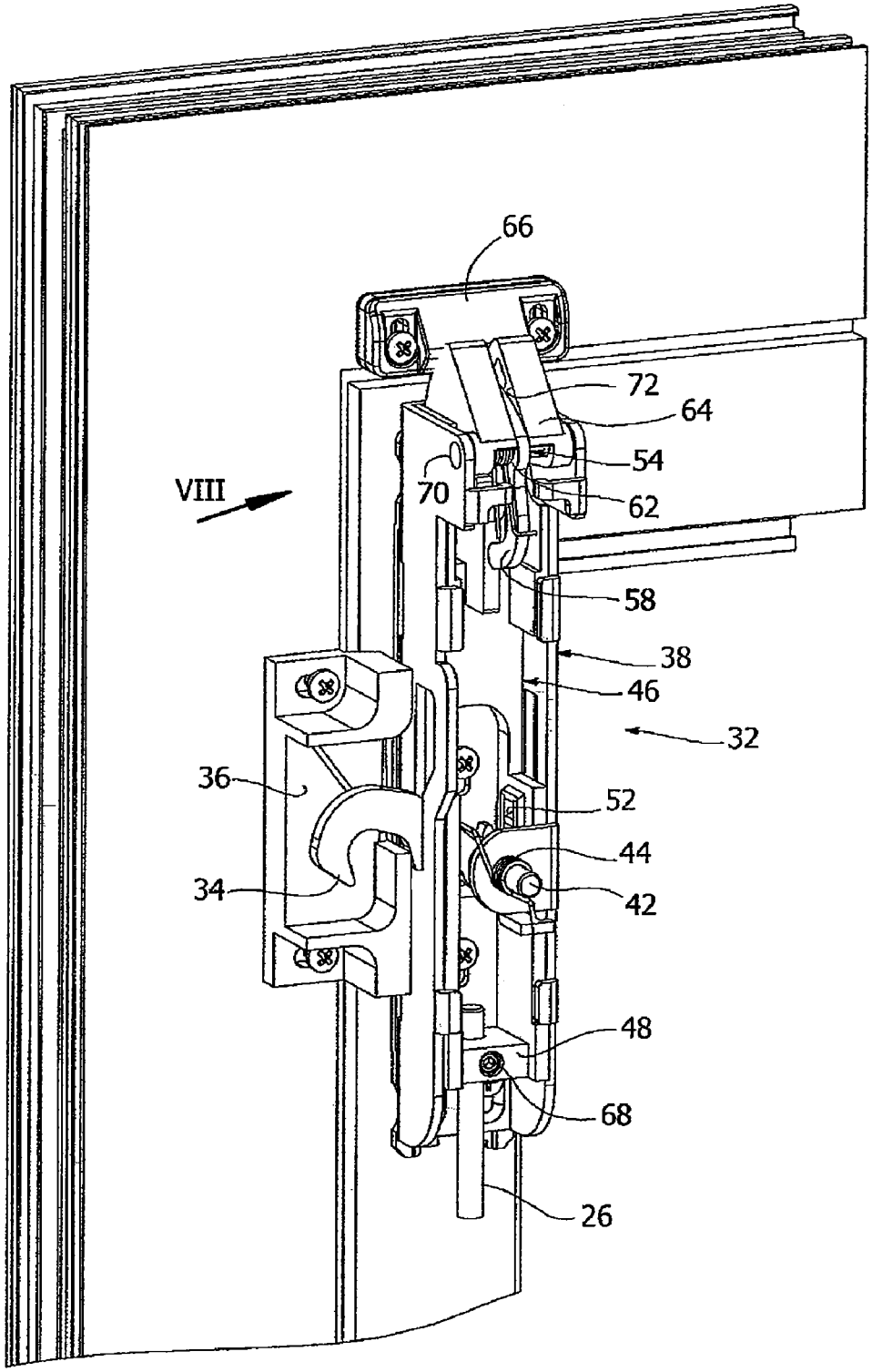
FIG. 7 is a perspective view of the auxiliary security module indicated by the arrow VII in FIG. 6, FIGS. 8 and 9 are perspective views according to the arrow III in FIG. 7 showing the security module in two positions.
Figure 8:
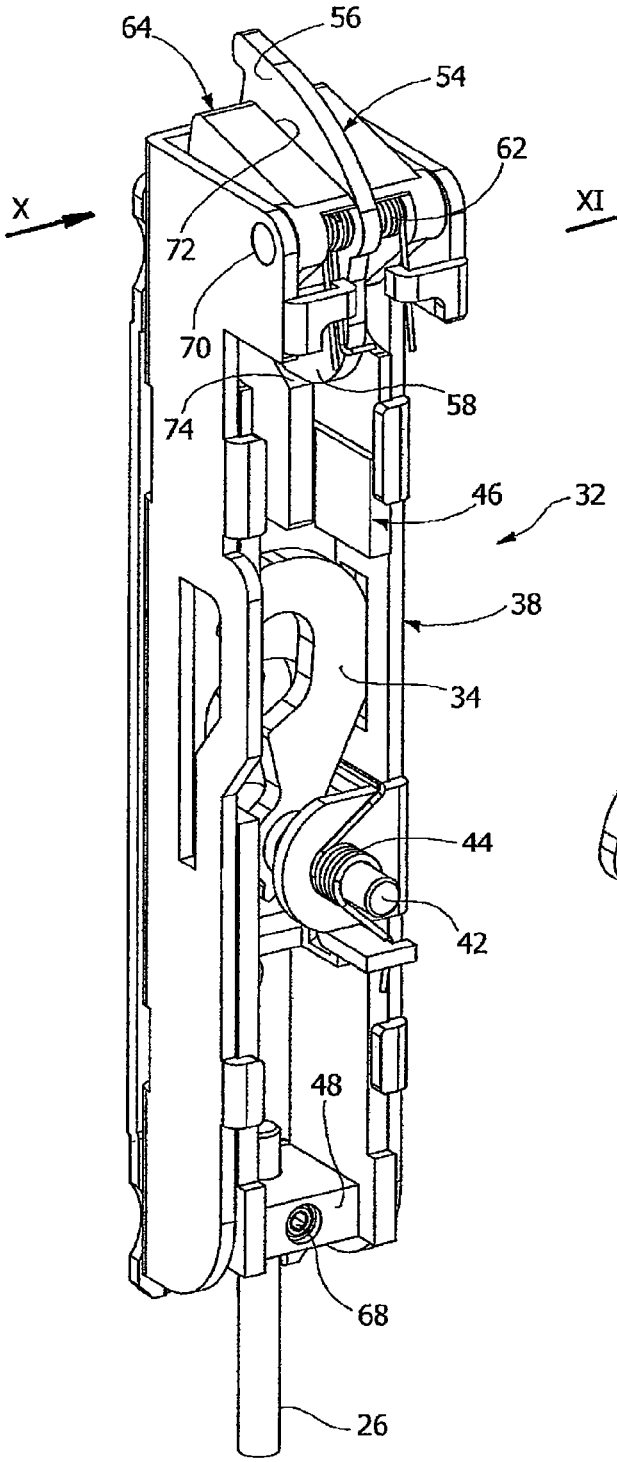
Figure 9:
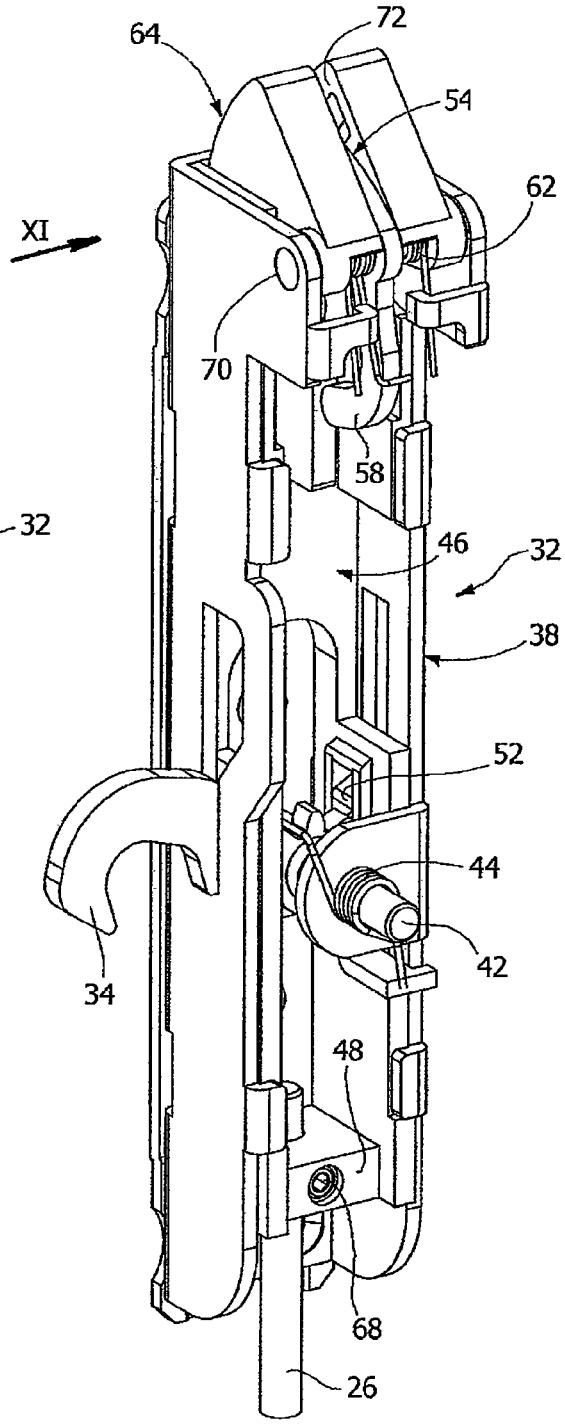

With reference to FIGS. 7, 8 and 9, the auxiliary security module 32 comprises a locking member 34 whose position is univocally correlated to the position of a cursor 46, identically to the embodiment described above. The upper end of the rod 26 is fastened to the cursor 46 by means of a screw 68. As in the version described previously, the locking member 34 is movable between an extracted position shown in FIGS. 7 and 9, which corresponds to a first position of the cursor 46 and a recessed position shown in FIG. 8 which corresponds to a second position of the cursor 46.

The upper end of the case 38 bears a pivot pin 70 that extends orthogonally relative to the pivot pin 42 around which the locking member 34 is articulated. The spring latch 64 is articulated to the case 38 around the pivot pin 70 and it is movable from the extracted position of FIG. 9 to the recessed position of FIG. 8. The spring latch 64 is connected to the spring latch 64, so that the spring latch 64 is in the recessed position shown in FIG. 8 when the cursor 46 is in its second position and in the extracted position of FIG. 9 when the cursor 46 is in its first position.

The spring latch 64 has a slit 72 in which the feeler 54 is inserted. The feeler 54 co-operates with a second elastic element 62 constituted by a pin spring positioned coaxially to the pivot pin 70.

Figure 10:
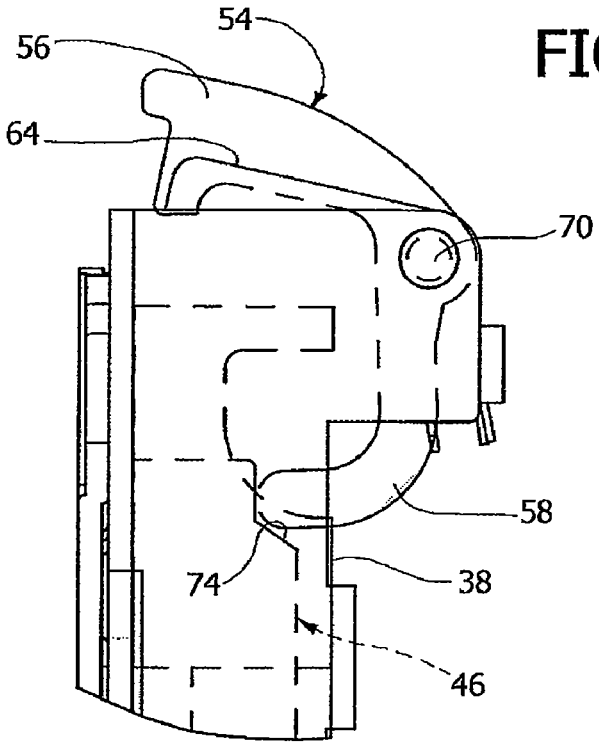
FIGS. 10 and 11 are partial front views respectively according to the arrows X and XI of FIGS. 8 and 9.

The engagement portion 58 of the feeler 54 co-operates with an engagement surface 74 of the cursor 46. FIGS. 8 and 10 show the condition in which the engagement portion 58 of the feeler 54 is in the engaged configuration with the cursor 46 and FIGS. 9 and 11 show a condition in which the cursor 46 is disengaged from the feeler 54.

Figure 11:
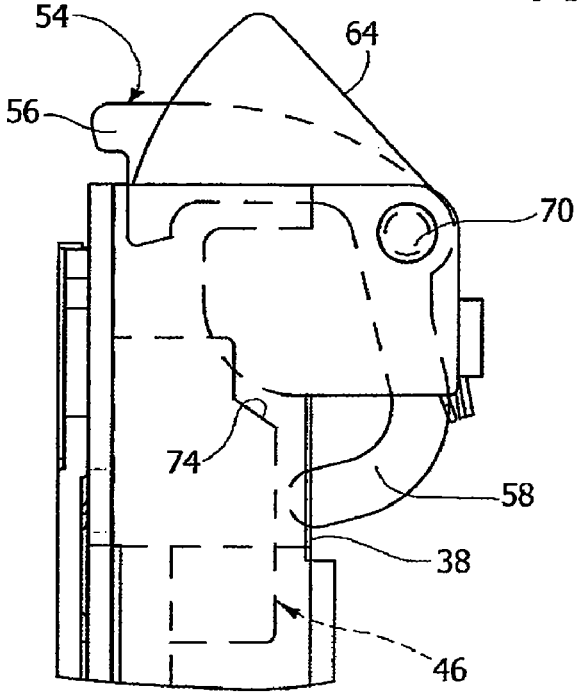

FIGS. 7, 9 and 11 show the configuration of the auxiliary security module 32 in the condition in which the wing 14 is closed. In this situation, the locking member 34 is in its extracted position and it engages the seat 36. The cursor 46 is in its first position. The spring latch 64 is in the extracted position and it co-operates in arresting relation with the abutment 66. The feeler 54 is held in disengaged position thanks to the portion 56 that co-operates with the abutment 66. The cursor 46 is then free to move towards its second position under the command of the rod 26.

In the open wing condition shown in FIGS. 8 and 10, the cursor 46 is in its second position, the locking member 34 is in its retracted position and the spring latch 64 is in the recessed position. The feeler 54 is thrust by the elastic element 60 to the engagement position and the engagement portion 58 of the feeler 54 is in arresting contact with the engagement surface 74 of the cursor 46. The auxiliary security module 32 automatically returns to the configuration of FIGS. 7, 9 and 11 when the wing closes, because the contact of the portion 56 of the feeler 54 with the upper abutment 66 brings the feeler 54 to the disengaged position.

FIGS. 12 through 17 show a third embodiment of the auxiliary security module according to the present invention.

Figure 12:
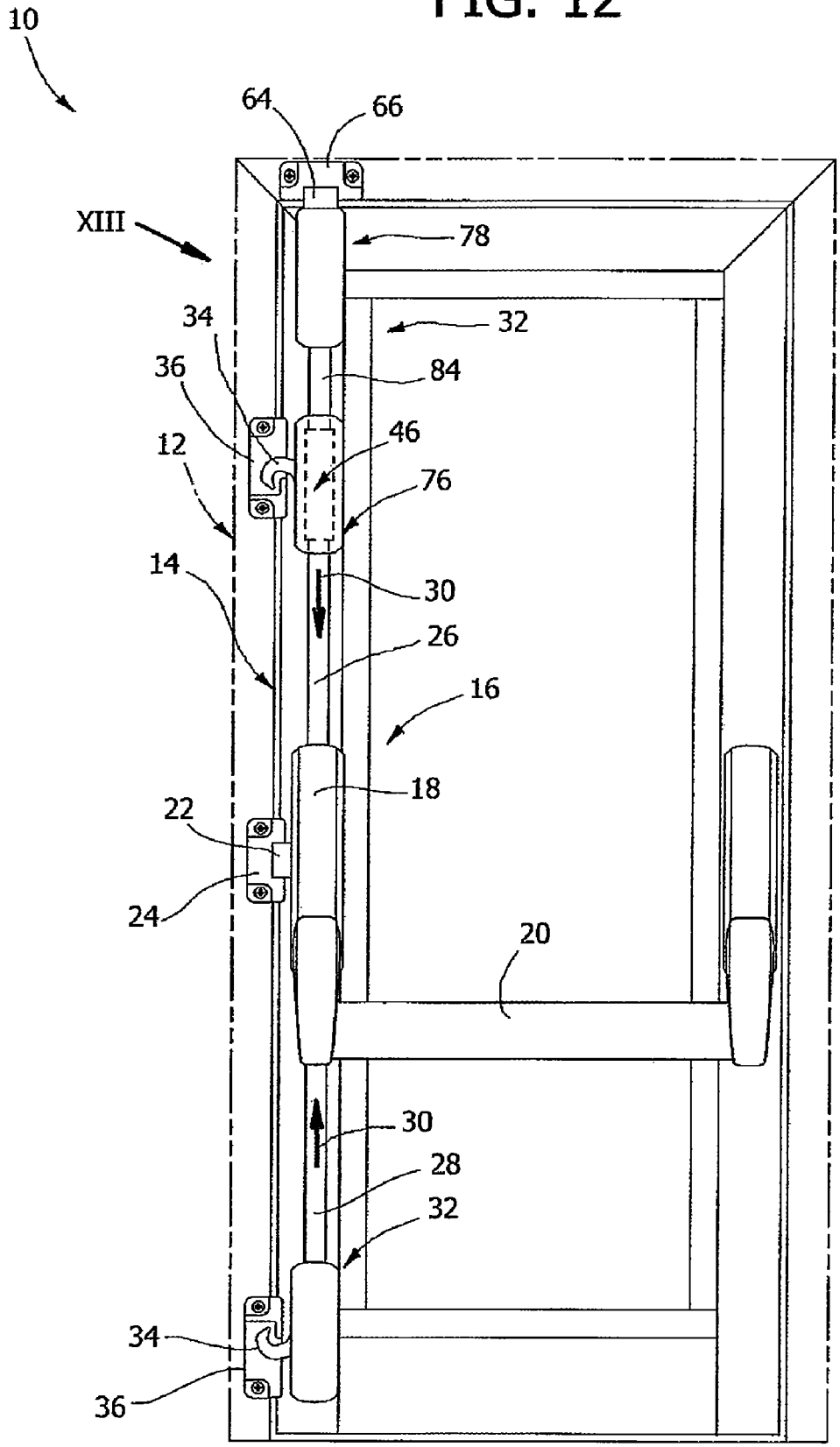
FIG. 12 is a front view of a door provided with a third embodiment of an auxiliary security module according to the invention.

With reference to FIG. 12, the upper auxiliary security module 32 comprises a locking assembly 76 and a feeler assembly 78. The locking assembly 76 comprises a locking member 34 movable between an extracted position and retracted position and connected to a cursor 46 movable between a first position corresponding to the extracted position of the locking member 34 and a second position corresponding to the retracted position of the locking member 34. The cursor 46 of the locking assembly 76 is fastened to the upper end of the rod 26.

Figure 13:
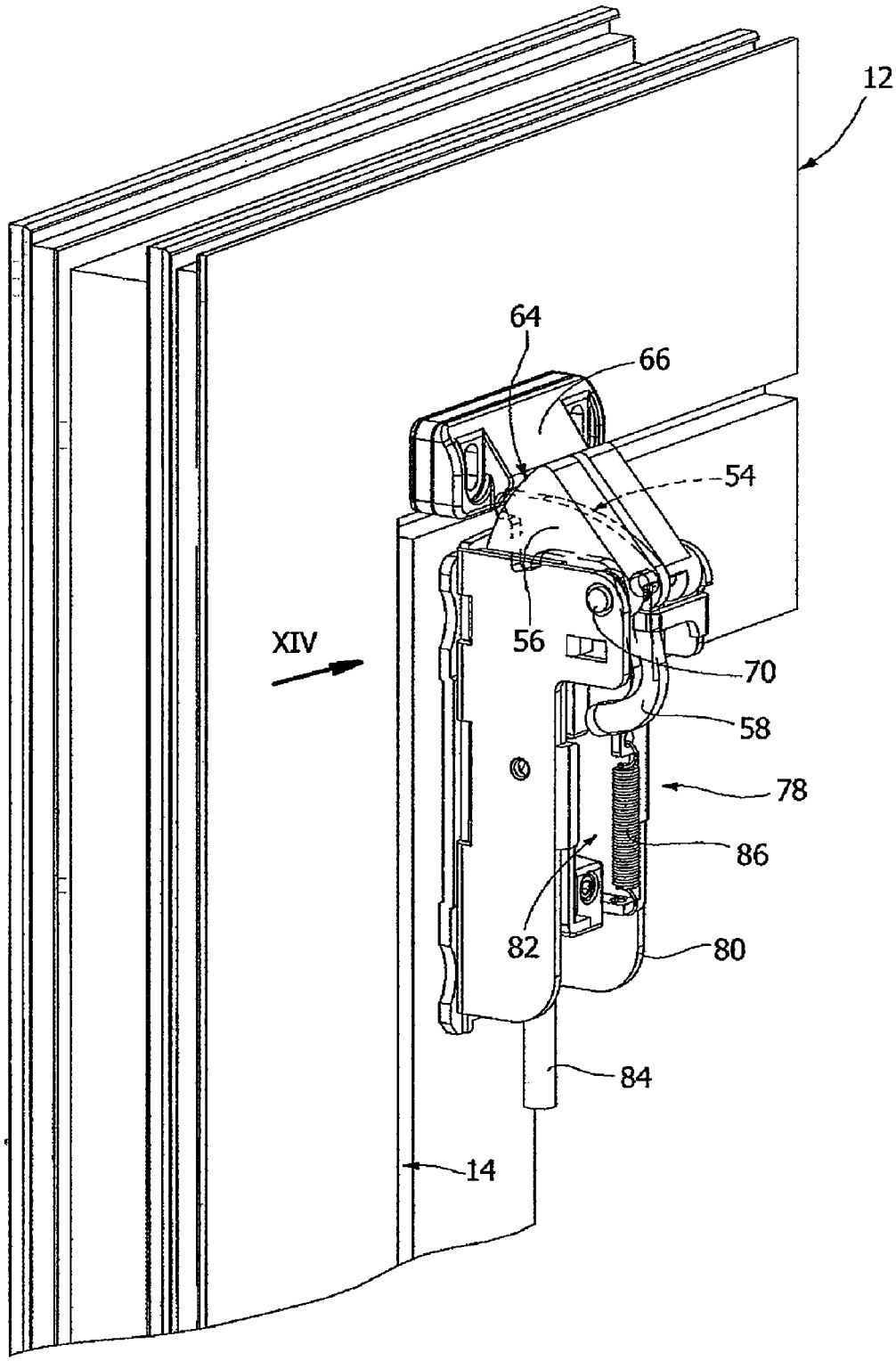
FIG. 13 is a perspective view of the part indicated by the arrow XIII in FIG. 12, FIGS. 14 and 15 are perspective views according to the arrow XIV of FIG. 13 in two positions.

With reference to FIG. 13, the feeler 78 comprises a case 80 fastened to the wing 14. The case 80 bears a pivot pin 70 around which are articulated an oscillating spring latch 64 and a feeler 54. The arrangement of the oscillating spring latch 64 and of the feeler 54 is essentially identical to the description provided with reference to FIGS. 7 through 11. The feeler assembly 78 comprises a cursor 82 movable between a first and a second position. The cursor 82 of the feeler assembly 78 is fastened to the cursor 46 of the locking assembly 76 by means of a rod 84. The cursors 46 and 82 are thus jointly movable between the first and the second position. The cursor 82 is associated to an elastic element 86 which tends to maintain the cursor 82 in the first position. The same elastic element 86 also tends to maintain the cursor 46 of the locking unit 76 in the first position and, consequently, it tends to maintain the locking member 34 in its extracted position.

Figure 14:
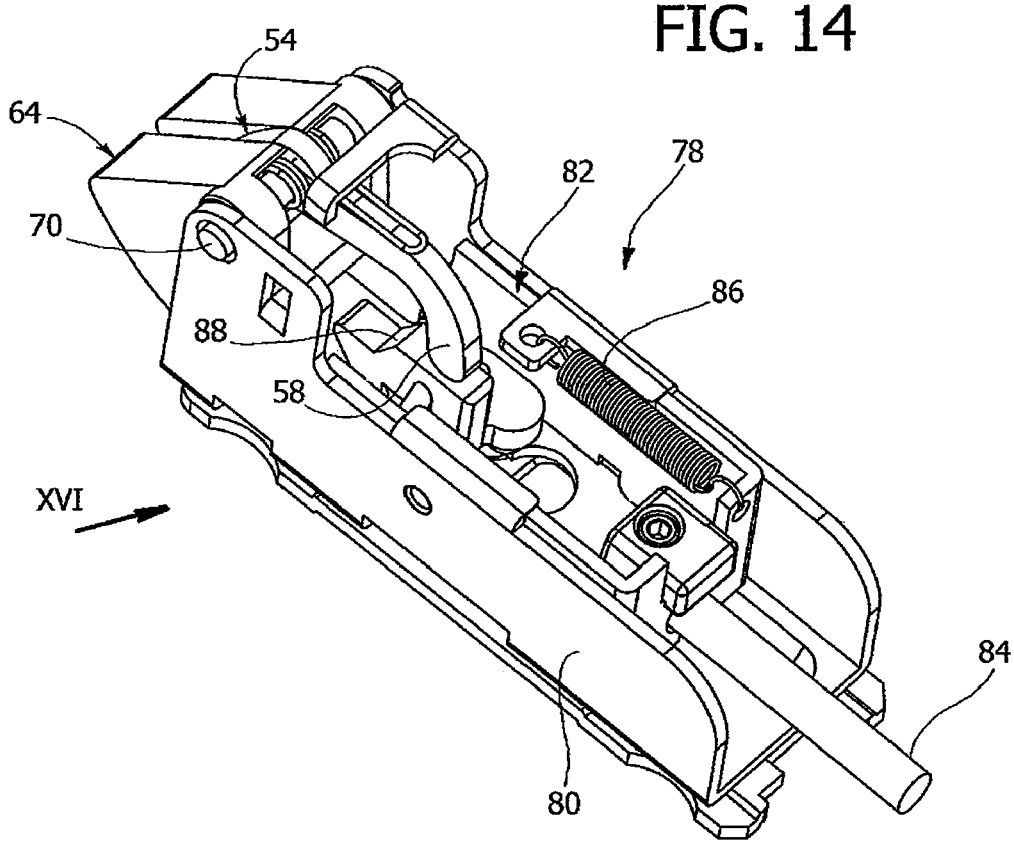
Figure 15:
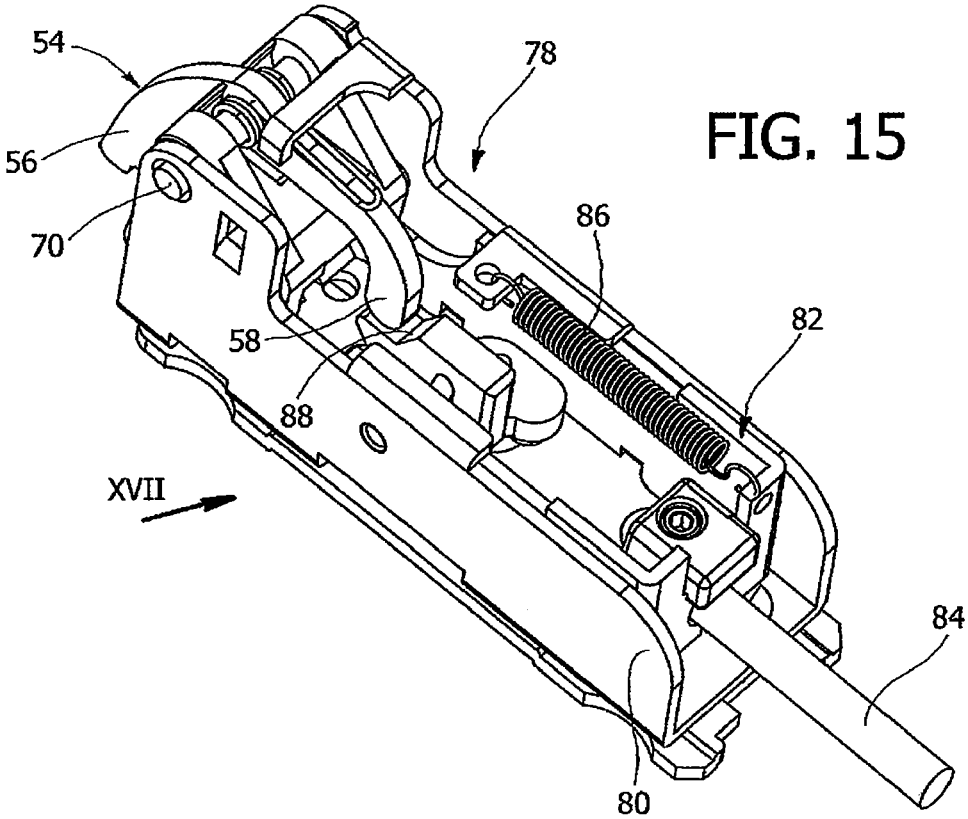
Figure 16:
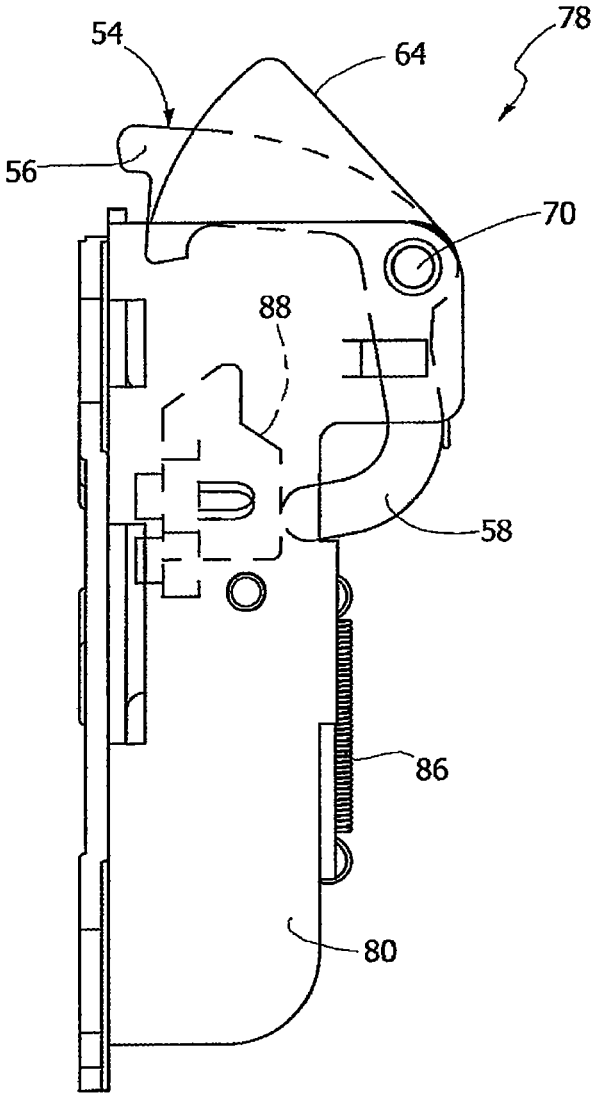
FIGS. 16 and 17 are partial front views respectively according to the arrows XVI and XVII of FIGS. 14 and 15.
Figure 17:
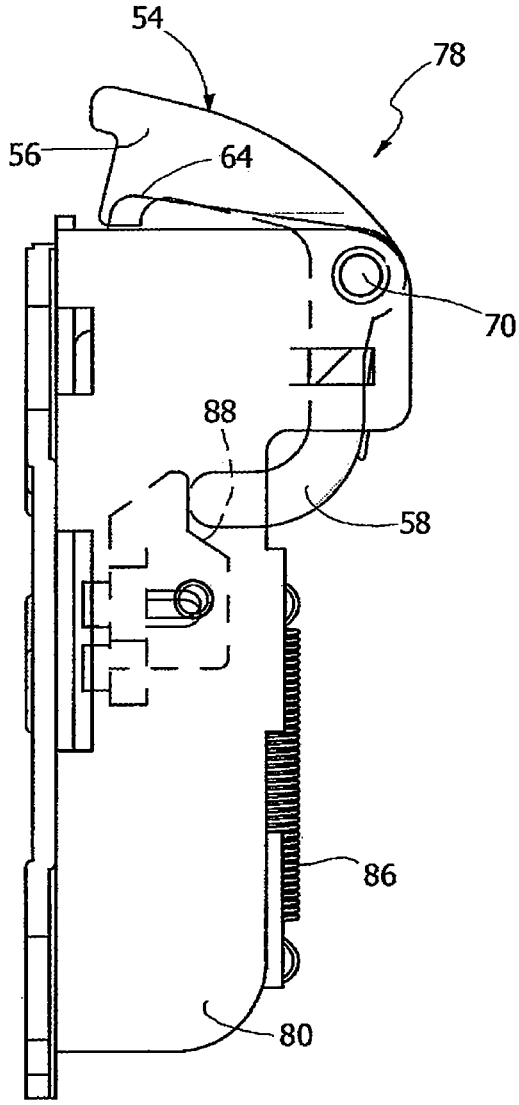

The engagement portion 58 of the feeler 54 co-operates with an engagement surface 88 of the cursor 82. In the open door configuration the feeler 54 is in an engaged position with the surface 88 whilst in the closed door position the feeler 54 is in a disengaged position with respect to the cursor 82. The operation of this third embodiment is identical to the operation of the second embodiment. FIGS. 13, 14 and 16 show the position of the components in the closed wing configuration. FIGS. 15, 17 and 17 show the position of the components in the open wing configuration.

FIGS. 18 through 23 show a fourth embodiment of the auxiliary security module according to the present invention. In this case as well, the details corresponding to the previously described ones are designated by the same numeric references.

This fourth embodiment has in common with the previously described embodiments the fact that it comprises a locking member 34 movable between an extracted engagement position and a retracted disengagement position, whose position is univocally correlated to the position of a cursor 46 connected to a rod 26.

Figure 22:
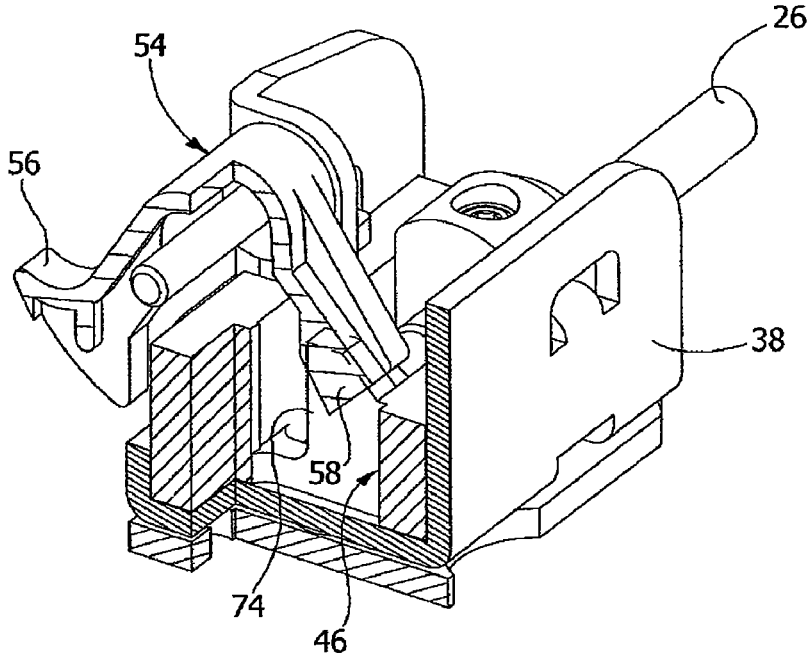
Figure 23:
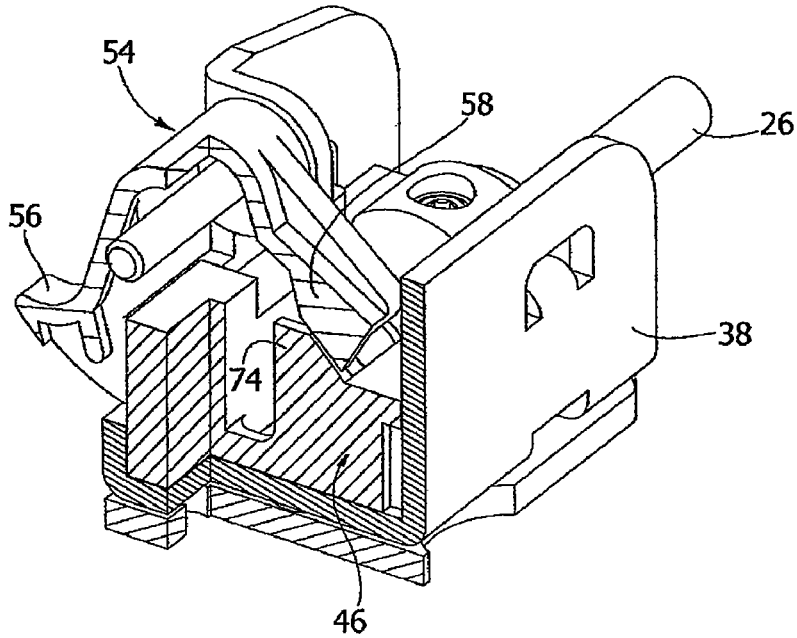

In this case, a feeler element 54 is provided, having a projecting portion 56 and a retaining portion 58 co-operating with a retaining surface 74 of the cursor 46 (FIGS. 22 and 23).

The difference with respect to the previous embodiment pertains to the feeler 54. In this case, the feeler 54 is mounted rotatable relative to the case 38 around an axis that is parallel to the direction of motion of the cursor 46. The projecting part 56 of the feeler 54 co-operates with the fixed seat 36 in which the locking member 34 engages. The projecting portion 56 and the retaining portion 58 project in radial direction relative to a central part that engages a trunnion (not shown in the figures). The feeler 54 is thrust towards its engagement position by an elastic element, not shown in the figures.

Figure 18:
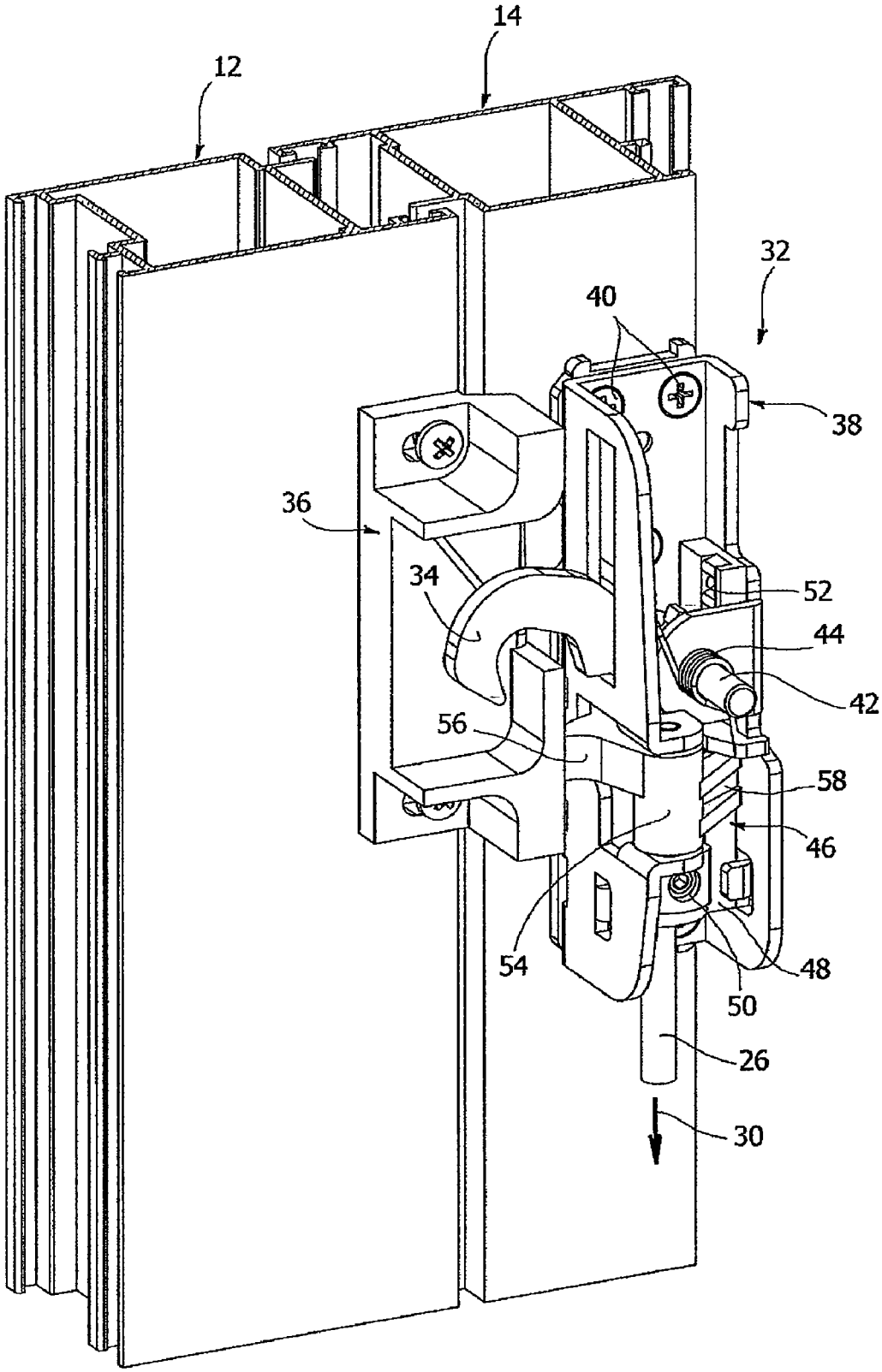
FIG. 18 is a perspective view of a fourth embodiment of an auxiliary security module according to the present invention.
Figure 19:
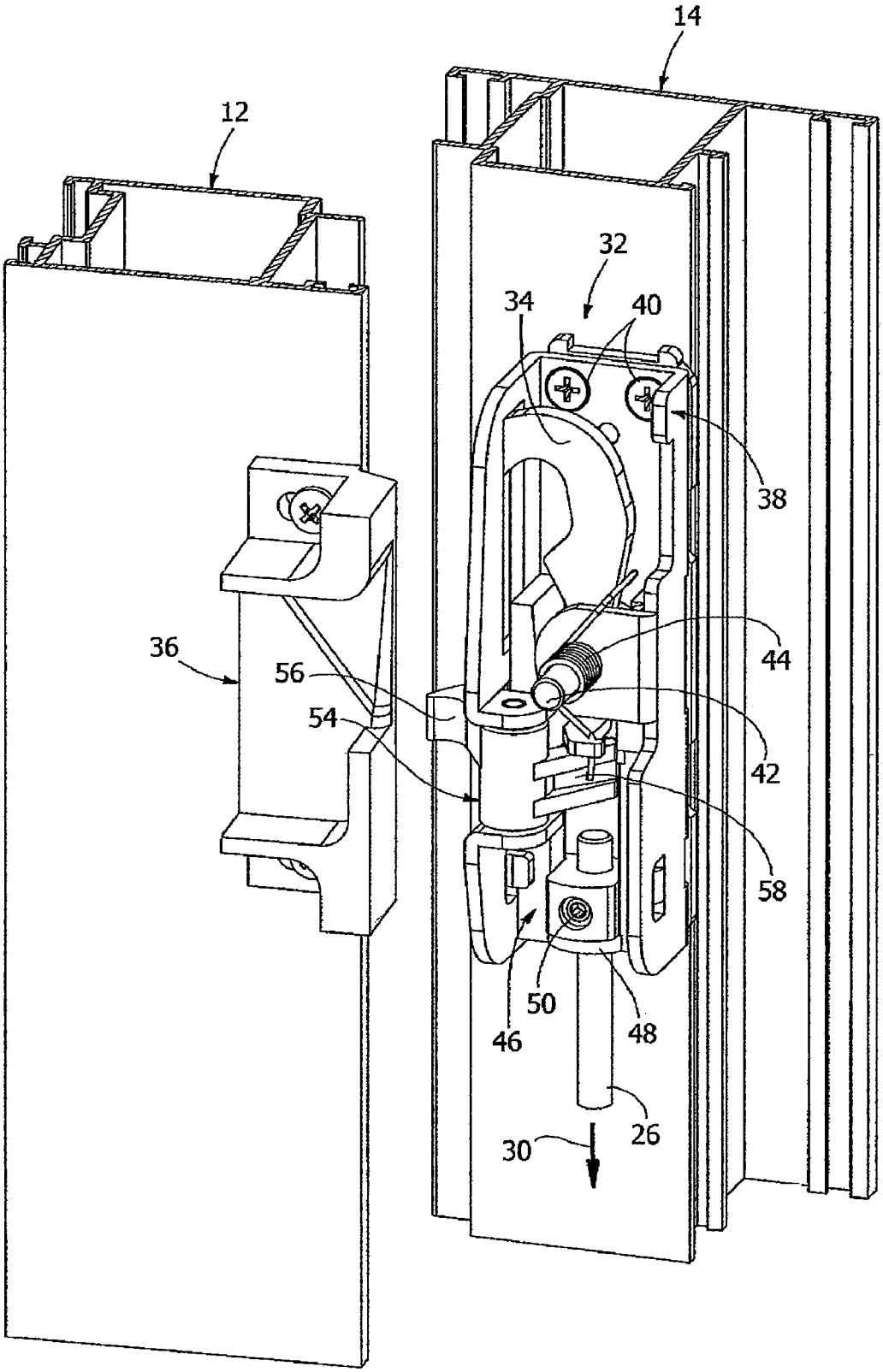
FIG. 19 is a perspective view of the security module of FIG. 18 in a second position.
Figure 20:
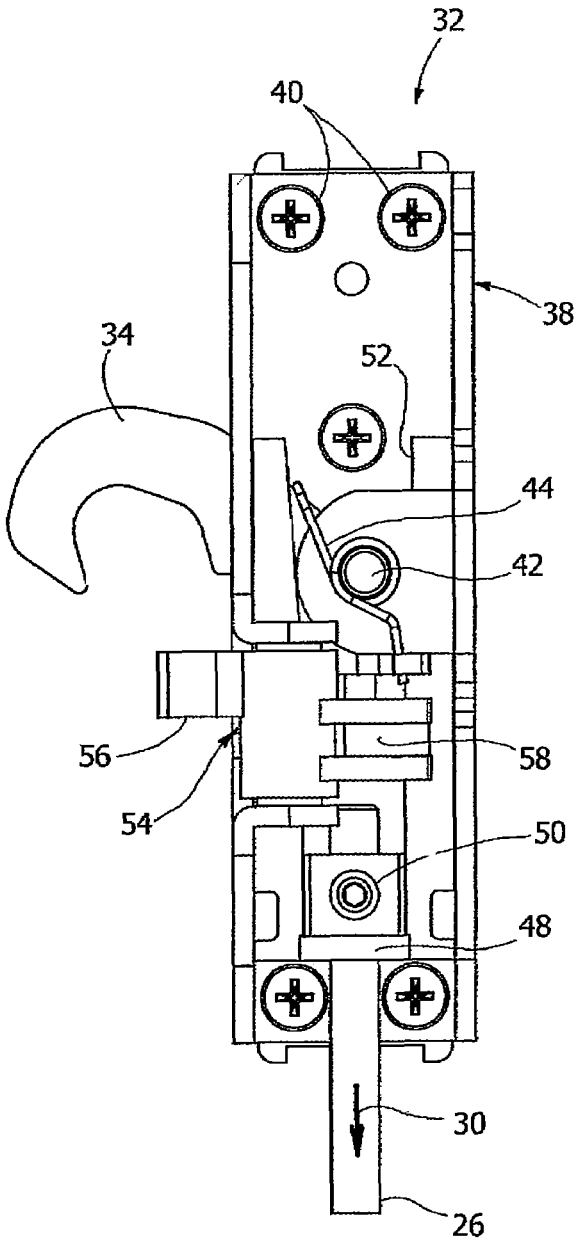
FIGS. 20 and 21 are front views showing the security module respectively in the positions of FIG. 18 and of FIG. 19, and FIGS. 22 and 23 are partially sectioned perspective views of the fourth embodiment of the module according to the invention in positions corresponding to the positions shown in FIGS. 18 and 19.
Figure 21:
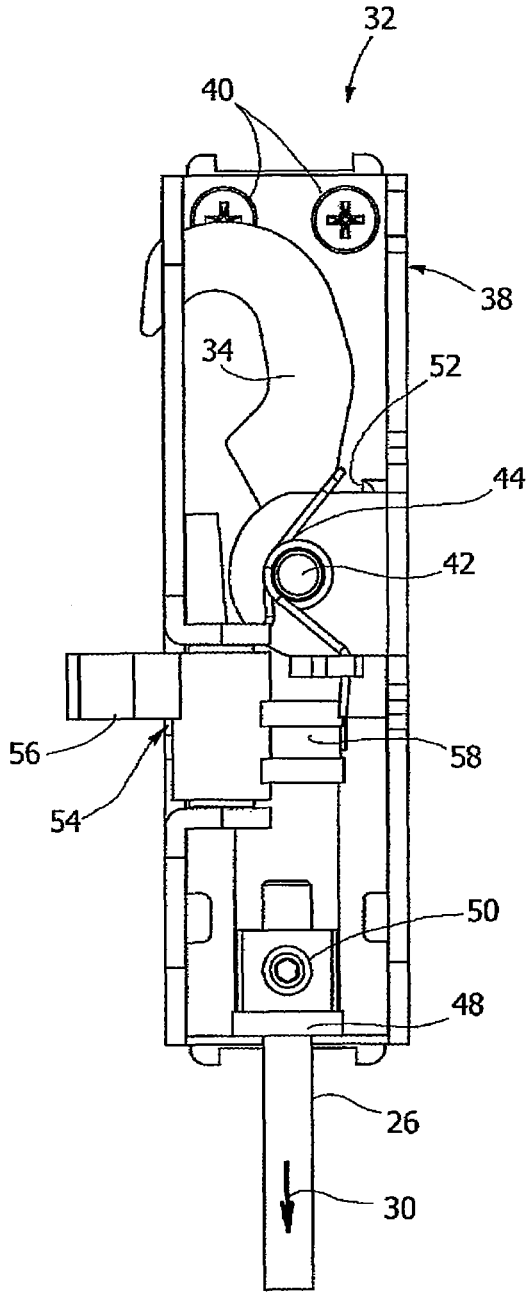

FIGS. 18, 20, 23 refer to the closed wing configuration. In this configuration, the locking member 34 engages the fixed seat 36, the cursor 46 is in its first position and the feeler 54 is in its disengaged position with respect to the cursor 46. FIGS. 19, 21 and 22 refer to the open wing configuration. In this configuration, the locking member 34 is in the recessed position, the cursor 46 is in its second position and the feeler 54 is in the engaged position in which it retains the cursor 46 in its second position against the action exercised by the spring 44. The operation of this fourth embodiment is identical to the operation of the embodiments described previously.

While the foregoing is directed to embodiments of the present invention, other and further embodiments of the invention may be devised without departing from the basic scope thereof, and the scope thereof is determined by the claims that follow.

The invention claimed is:

1. An auxiliary safety module for doors connected with an anti-panic opening device having at least one rod, comprising:

a rotating locking member movable between an extracted position and a recessed position, a first elastic element tending to maintain the locking member in its extracted position, a cursor movable between a first position and a second position, a transmission mechanism operatively associated with the cursor and with the locking member and arranged to establish a correlation between the positions of the cursor and of the locking member, so that when the cursor is in its first position, the locking member is in the extracted position and when the cursor is in the second position, the locking member is in the recessed position, a movable feeler having a projecting portion and a retaining portion which co-operates with the cursor, the feeler being movable between an engaged position and a disengaged position through its disengagement and engagement with an abutment, a second elastic element associated with the feeler and tending to maintain the feeler in said engaged position, wherein, when the feeler is in its disengaged position, the cursor is free to move between the first and the second position and vice versa and wherein when the feeler is in the engaged position, the cursor is locked in its second position;

the rotating locking member is hook-shaped and is articulated to a first pin extending orthogonally relative to the direction of motion of said cursor in order to engage a fixed seat of a fixed frame to lock a door;

the feeler having a rocking lever shape, with the projecting portion and the retaining portion positioned at opposite parts relative to a central articulation portion having a second pin, the feeler being articulated around the second pin that is extending orthogonal relative to the direction of motion of the cursor and extending orthogonal with respect to the first pin of the locking member; and the auxiliary safety module comprising an oscillating spring latch articulated around said second pin, the spring latch having a slit in which the feeler is housed.

2. The safety module as claimed in claim 1, wherein the oscillating spring latch is connected to the cursor and it can move between an extracted position corresponding to the first position of the cursor and a recessed position corresponding to the second position of the cursor.

* * * * *